US005530460A

United States Patent [19]

Wehl

[11] Patent Number: 5,530,460

[45] Date of Patent: Jun. 25, 1996

[54] METHOD FOR ADJUSTMENT OF A SERIAL RECORDING DEVICE

[75] Inventor: Wolfgang Wehl, Berlin, Germany

[73] Assignee: Eastman Kodak Company, Rochester, N.Y.

[21] Appl. No.: 210,128

[22] Filed: Mar. 17, 1994

Related U.S. Application Data

[63] Continuation of Ser. No. 699,932, May 14, 1991, abandoned.

[30] Foreign Application Priority Data

May 14, 1990 [DE] Germany ..... 40 15 799.7

[51] Int. Cl.[6] ..... B41J 2/01

[52] U.S. Cl. ..... 347/19; 347/40

[58] Field of Search ..... 347/19, 40, 41

[56] References Cited

U.S. PATENT DOCUMENTS

| | | | |
|---|---|---|---|
| 4,748,453 | 5/1988 | Lin et al. | 347/41 |
| 4,878,063 | 10/1989 | Katerberg | 347/19 |
| 5,070,345 | 12/1991 | Lahut et al. | 347/40 |

FOREIGN PATENT DOCUMENTS

| | | | |
|---|---|---|---|
| 194566 | 11/1983 | Japan | 347/19 |
| 135379 | 6/1987 | Japan | 347/19 |
| 153151 | 6/1988 | Japan | 347/19 |

*Primary Examiner*—N. Le
*Attorney, Agent, or Firm*—Milton S. Sales

[57] ABSTRACT

In a serial recording device (10) with a recording head (12), movable back and forth perpendicular to the feed direction (17) of a recording substrate (18), the recording head (12) performs a recording both during the forward motion (28) as well as during the return motion (32) in a bidirectional printing. For obtaining a good recording result, it is is required that the relative position of the grid pattern, generated during the forward motion (28), coincides with and matches the grid pattern, generated during the return motion (32) of the recording head. During a test recording process, a first test pattern (31) is recorded initially at least once during the forward motion (28), and then a second test pattern (33) is recorded at least once during the return motion (32) for a balancing of the relative position. An adjustment is performed in the sense that, during a further test recording process, the first test pattern (31) is disposed symmetrically relative to the second test pattern (33) depending on the relative position of the first test pattern (31) and of the second test pattern (33) to each other.

3 Claims, 4 Drawing Sheets

METHOD FOR ADJUSTMENT OF A SERIAL RECORDING DEVICE

This is a continuation of application Ser. No. 07/699,932, filed May 14, 1991, now abandoned.

BACKGROUND OF THE INVENTION

1. Field of the Invention

The invention relates to a method for balancing and adjusting a serial recording device with a recording head, where the recording head is capable of recording characters according to a grid pattern absolute and proper to recording device both during a forward motion as well as during a return motion of the recording head opposed to the advance direction of a recording substrate.

2. Brief Description of the Background of the Invention Including Prior Art

In serial recording devices there is provided a recording head which includes one or several recording elements, disposed one below the other relative to the feed direction of a recording substrate, for example a paper sheet. These recording elements are furnished by ink jets according to a recording device known from the German Printed Patent document DE-OS 2,925,812. The recording head is disposed such that it can be moved back and forth perpendicular to the feed direction for performing the recording.

To increase the print speed or to improve the print image in connection with serial recording devices, it is known from the German Printed Patent document DE-OS 2,925,812 to perform a recording both during the forward as well as during the return motion of the recording head, i.e. to perform a bidirectional recording. The characters to be recorded, for example, individual image dots, are delivered, both upon recording during the forward motion of the recording head as well as upon recording during the return motion, to the grid dots of a grid pattern proper to the recording device, representing an absolute grid pattern.

The problem arises that, based on the positioning tolerances of the print head relative to the paper, the grid pattern of the dots recorded during a forward motion of the recording head does not coincide with the grid pattern of the dots recorded during the return motion of the recording head, based on constructive tolerances and based on unforeseen flight speed differences of ink drops in connection with an ink print device. In particular in case of the respective line connection, this leads to distortions, defects, falsifications, and mispositionings of the recorded characters and patterns, where the human eye is particularly sensitive to such distortions and mispositionings.

SUMMARY OF THE INVENTION

1. Purposes of the Invention

It is an object of the present invention to provide a method for balancing and adjusting a serial recording device, whereby a staggering of grid dots, i.e. a timing error of the dots, recorded during the forward motion, relative to the dots, recorded the return motion, is eliminated.

These and other objects and advantages of the present invention will become evident from the description which follows.

2. Brief Description of the Invention

According to the present invention, there is provided for a method for the adjustment of a serial recording device with a recording head. Both during a forward motion in a left/right direction as well as during return motion in a right/left direction and perpendicular to a transport advance direction of a recording substrate, the recording beard is capable of recording characters according to recording-device-proper, absolute grid pattern. The following method steps are employed:

A test recording process is initiated. A forward motion is performed. At least once a first test pattern is recorded during the forward motion. A return motion is performed. At least once a second test pattern is recorded during the return motion. The first test pattern and the second test pattern are generated relative to the absolute grid pattern such that at least a part of the second test pattern is generated symmetrically in a region of a free space contained in the first test pattern. A readjustment is performed in the sense that, during a further test recording process, one part of the first test pattern comes to be disposed symmetrically in region left open between imprinted marks of the second test pattern, depending on an actual relative position of said one part of the first test pattern relative to the second test pattern on the recording substrate.

As first test pattern and as second test pattern there can be employed test patterns extending essentially in the transport advance direction of the recording substrate.

A first line, a second line, a third line, and a fourth line can be employed to form a first test pattern running in the transport advance direction of the recording substrate. A first line and a second line are employed to form a second test pattern running in the transport advance direction of the recording substrate. The lines can be disposed parallel to each other in the transport advance direction of the recording substrate.

A first region left open between imprinted marks can be formed between the first line and the second line of the first test pattern. A second region left open between imprinted marks can be formed between the second line and the third line of the first test pattern. A third region left open between imprinted marks can be formed between the third line and the fourth line of the first test pattern. The first region left open between imprinted marks between the first line and the second line of the first test pattern can be dimensioned different from the third region left open between imprinted marks between the fourth and the third line of the first test pattern. A first region left open between imprinted marks can be formed in the second test pattern between the first and the second line of the second test pattern. The first region left open between imprinted marks, formed in the second test pattern between the first and the second line of the second test pattern, corresponds to a centered distance of the first region left open between imprinted marks and the third region left open between imprinted marks of the first test pattern, wherein said centered distance can be delimited respectively by the first line and by the fourth line of the first test pattern.

A number, larger than the number 1, of the first test pattern can be recorded in the direction of the forward motion distributed onto the recording substrate. The second test pattern can be recorded during the return motion in a corresponding number and distribution onto the recording substrate.

According to the present invention, the following method steps are employed:

In a test recording process, at least one first test pattern is recorded during the forward motion, and at least one second test pattern is recorded during the return motion. The test patterns are generated with respect to the absolute grid pattern such that at least one part of the one test pattern is generated symmetrically in the region left open between imprinted marks contained within the second test pattern.

An adjustment is performed in the sense that, after a further test recording process, the one part of the one test pattern is disposed symmetrically in the left open between imprinted marks of the second test pattern, depending on the actual relative position of the one part of the first test pattern, to the second test pattern on the recording substrate.

It is understood that after the recording of the test pattern there is determined initially if the actual relative position of the first test pattern or, respectively, of a part of the first test pattern, relative to the region of the second test pattern, is already symmetrically disposed on the recording substrate. If it is disposed symmetrically on the recording substrate, clear an adjustment can be dispensed with, since the recording device is already optimally adjusted in this case.

The invention method is associated with the advantage that an adjustment can be performed without a printer-alien, or external adjustment device by service personnel or by the operator of the recording device and thus a substantial improvement of the recording results can be achieved. A particularly accurate adjustment can be achieved by performing the setting and adjustment in the sense that one test pattern, or a part of a test pattern, is disposed symmetrically in the region of the second test pattern. Such a symmetry can be particularly easily recognized both by the human eye as well as by automatic scanning and testing units. In case of an optimum adjustment, the grid patterns of the forward motion or the return motion, respectively, coincide and agree. The characters produced during the return motion are thus disposed in a correct, relative position, corresponding to the recording-device-proper, absolute grid pattern relative to the characters produced during the forward motion.

The adjustment can be performed, for example, by a mechanical adjustment of the recording head on its support or by changing of the timing control of the recording elements relative to the actual position of the recording head. The actual position is determined, for example, by way of a sensor. This sensor cooperates with a code ruler, fixedly disposed in the recording device. The adjustment values, set in the course of a change of the timing control, are preferably permanently recorded as offset values in a memory storage coordinated to the control of the recording device. It is advantageous if a line advance is completely suppressed during the forward motion and the return motion, because the characters or dots, respectively, delivered by the same recording element, are thereby disposed in a line running perpendicular to the direction of the recording substrate, and because deviations in the position of possibly several recording elements, disposed one below the other as seen in feed direction of the recording substrate, do not influence the determination of the test pattern.

An advantageous embodiment of the invention method comprises that test patterns are employed as a first test pattern and a second test pattern which extend substantially in the transport advance direction of the recording substrate. In this manner, the sensitivity of the human eye can be particularly advantageously employed for the balancing or, respectively, a scanning device for achieving an adjustment can be particularly simply constructed.

According to a further embodiment of the invention, lines, running in the transport advance direction of the recording substrate, are employed as a first test grid pattern and as a second test grid pattern, since the control of the recording head is particularly simple for such linearly shaped-test grid patterns. These test grid patterns exhibit a particularly small memory storage requirement, such that the character storage of the recording device is hardly subjected to an additional loading.

A particularly advantageous further embodiment of the present invention method comprises that the first test grid pattern is formed by four lines, running parallel to each other in the transport advance direction of the recording substrate, wherein the distance between the one outer line and the next neighboring line is different from the distance of the other outer line and the line, neighboring this other outer line. The second test grid pattern is furnished by two lines, running parallel to each other in advance transport advance direction of the recording substrate, wherein the distance of the two lines to each other corresponds to the center distance of the respective left open between imprinted marks delimited by the outer line of the four lines of the first test pattern. In other words, the second test pattern is disposed such that the two lines of the second test pattern are to correspond in each case to the position of the center of two neighboring lines of the first test pattern. In this way, an adjustment within two resolution regions, coarse and fine, can be performed with the same test grid patterns. The left open between imprinted marks of the first test grid pattern is employed for the coarse adjustment, where the region is formed between the outer line and the farthest removed neighboring further line. The adjustment is performed in the sense that the corresponding line of the second test pattern is disposed approximately symmetrically between these two above-recited lines of the first test pattern. The accuracy of the adjustment is increased in a further test recording process with the aid of the left open between imprinted marks, formed between the second outer line and the next neighboring line of the first test pattern, and the second line of the second test pattern, in that the second line of the second test pattern is now also symmetrically adjusted in the above-recited region.

In order to exclude an accidental influencing of the adjustment by irregularities dispersed by the forward motion or the return motion, respectively, i.e. periodic or repetitive influences, for example, due to cyclic, running malfunctions of the recording head drive, according to a further advantageous embodiment, one number, larger than one, of the first test grid pattern is recorded in the direction of the forward motion distributed on the recording substrate and the second test pattern is recorded in a corresponding number and distribution during the return motion.

It is understood by a person of ordinary skill in the art that the two test grid patterns could also be recorded in a reverse time sequence, without leaving the scope of the present invention.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figure 1:
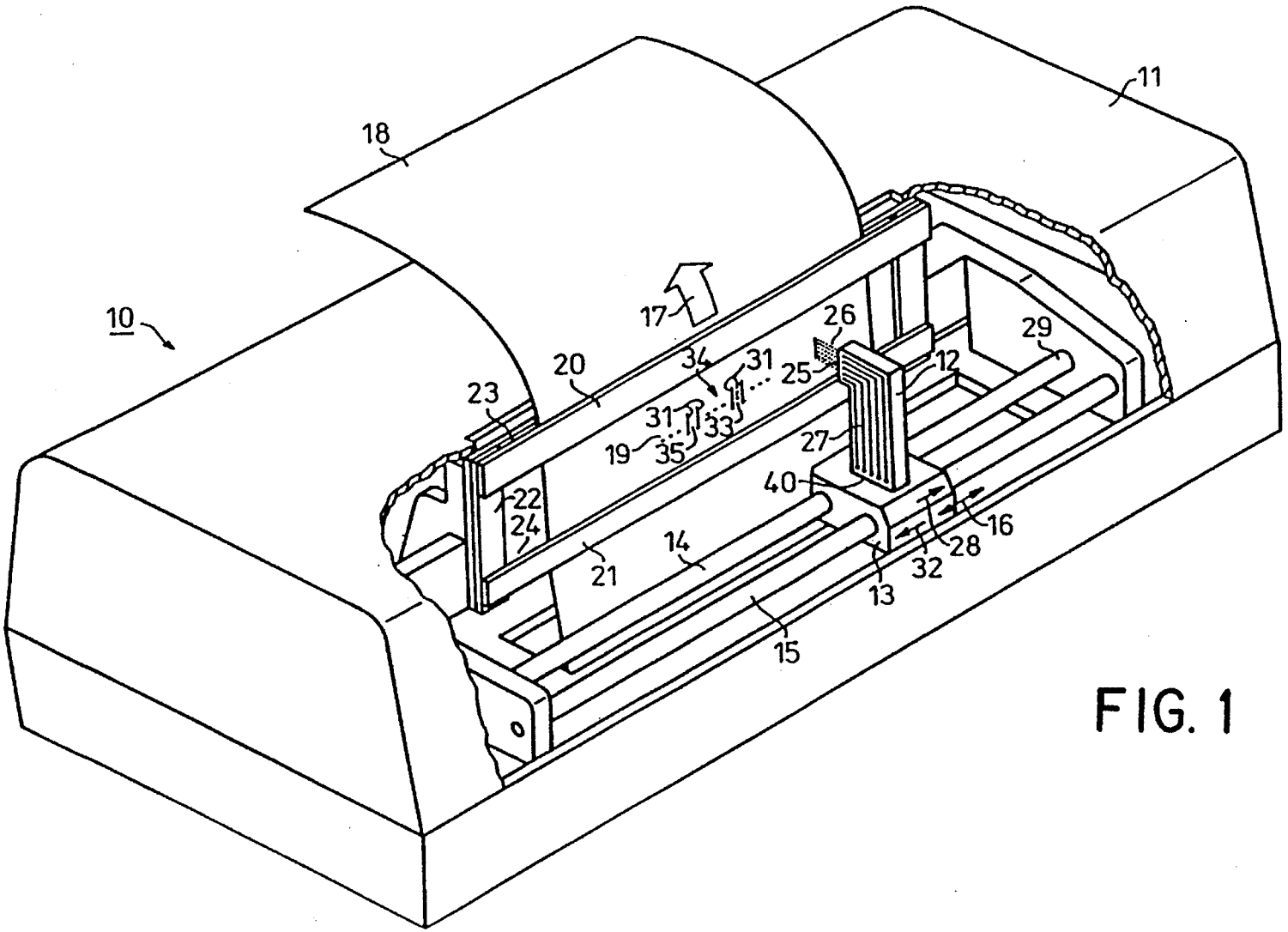
FIG. 1 is a perspective view of a recording device, where the invention method is employed.

The present invention provides for a method for the adjustment of a serial recording device 10 with a recording head 12. The recording head 12 if capable of recording, both during a forward motion 28 in a right direction as well as during return motion 32 in a left direction perpendicular to a transport advance direction 17 of a recording substrate 18, characters according to a recording-device-proper, absolute grid pattern. The invention method includes the following steps.

A test recording process is initiated. A first test pattern 31 is recorded at least once during the forward motion 28. A second test pattern 33 is recorded at least once during return motion 32. The test patterns 31, 33 are generated relative to the absolute grid pattern such that at least a part of the second test pattern 33 is generated symmetrically in a region of a region 35 left open between imprinted marks contained in the first test pattern 31. A readjustment is performed in the sense that, during a further test recording process, the one part of the first test pattern 31 comes to be disposed symmetrically in the region 35 of the second test pattern 33, depending on the actual relative position of the one part of the first test pattern 31 relative to the second test pattern 33 on the recording substrate 18.

Test patterns, extending essentially in the transport advance direction 17 of the paper substrate 18, can be employed as first test pattern 31 and as second test pattern 33.

Lines 51, 53, 55, 57; 61, 63 can be employed as first test pattern 50 and as second test pattern 60 running in advance direction 17 of the recording substrate 18.

The first test pattern 50 can be formed by four lines 51, 53, 55, 57, disposed parallel to each other and in transport advance direction 17 of the recording substrate 18. The distance between the one outer line 51 and the line 53, neighboring to the outer line 51, can be different relative to the distance of the other outer line 57 and the line 55, neighboring to the outer line 57. The second test pattern 60 can be formed by two lines 61, 63, disposed parallel to each other and in transport advance direction 17 of the recording substrate 18. The distance of the two lines 61, 63 relative to each other can correspond to the center distance of or region 52, 56 left open between imprinted marks respectively limited by the outer lines 51, 57 of the four lines 51, 53, 55, 57 of the first test pattern 50.

A number, larger than 1, of the first test pattern 31 can be recorded in the direction of the forward motion 28 distributed onto the recording substrate 18. The second test pattern 33 can be recorded during the return motion 32 in a corresponding number and distribution onto the recording substrate 18.

A schematic illustration of a recording device 10, formed as an ink jet printer, is illustrated in FIG. 1 with a partially broken-out casing 11. A recording head 12 is disposed in the casing 11. The recording head 12 is mounted to a support 13, which support 13 is slidably supported on guide rods 14 and 15. A forward and return motion of the support 13 in the arrow direction 16 and thus of the recording head 12 is performed by a motor drive, not illustrated in detail, disposed in the casing 11. A recording substrate 18 is forward movable along an advance direction through a transport device, not illustrated in detail and contained in the casing 11. The recording substrate 18 is guided in the recording region 19 by slots 23 and 24, formed by guide elements 20, 21, and 22. The recording head 12 is formed as an ink print head and comprises a plurality of, for example, fifty superposed recording elements, disposed perpendicular to the motion direction 16, i.e. in the transport advance direction 17 of the recording substrate. The recording elements are shaped as individual ink jets 25. The ink jets 25 eject ink droplets, which reach the recording substrate 18 along flight paths 26. A local heating of the ink is caused for the ejection of an ink droplet inside of a chamber, delimited on one side by the respective ink nozzle 25, by control of a heating element in the chamber. The local heating of the ink results in the formation of a vapor bubble. The vapor pressure finally results in the ejection of an ink droplet, according to the bubble jet principle. The conductor paths 27 can be recognized as indicated in the partially cut-free recording head 12. The individual heating elements are controlled by the conductor paths 27.

The recording head performs a forward motion 28 in a direction toward a right stop 29. The recording head 12 has thereby already applied a number of a first test patterns 31 to the recording substrate 18 wherein one test pattern 31 comprises two vertical lines. For purposes of simplicity, only two test patterns 31 are illustrated. The recording head 12 applies a further first test pattern 31 onto the recording substrate 18 in the position illustrated. A number of the nozzles 25, disposed vertically one below the other, ejects in each case an ink droplet for generating a line. The test patterns 31 are generated at matrix dots of an absolute grid pattern proper to the recording device. The recording head 12 applies a second test grid pattern 33 onto the recording substrate 18 during a return motion in the direction 32, which is illustrated in FIG. 1 only by a dashed line, because it is only generated in the return motion direction 32. The second test pattern 33, disposed in addition to the first test pattern 31, forms a complete test pattern 34 in a region 35 left open between imprinted marks between the lines of the first test pattern 31. The second test pattern 33 is generated at the matrix dots of the absolute grid pattern, proper to the recording device, such that the test pattern 33 is generated symmetrically between the lines of the test pattern 31 relative to the absolute grid pattern.

All first test patterns 31 are in each case completed with a second test pattern 33, disposed in the region 35 between the lines, to form a complete test pattern 34, after the recording head 12 has performed a forward motion 28 and a return motion 32. The user can recognize with the naked eye or with a scanning device in which sense an adjustment has to be performed from the position of the second test pattern 33 relative to the first test pattern 31 in the area of the region 35. Based on the above-described generation of the test patterns 31 and 33 relative to the absolute grid pattern, there is provided an optimum setting by a symmetric position of the test pattern 33 in the region 35 of the test pattern 31. Either the position of the recording head 12 on the support 13, in the sense of a change of the spacing of its ink nozzle 25 relative to the recording substrate, can be changed with the aid of an adjustment device 40 for the optimum setting, or the timing of the droplet ejection from the nozzles 25 can be correspondingly changed in the control of the recording device.

Figure 2:
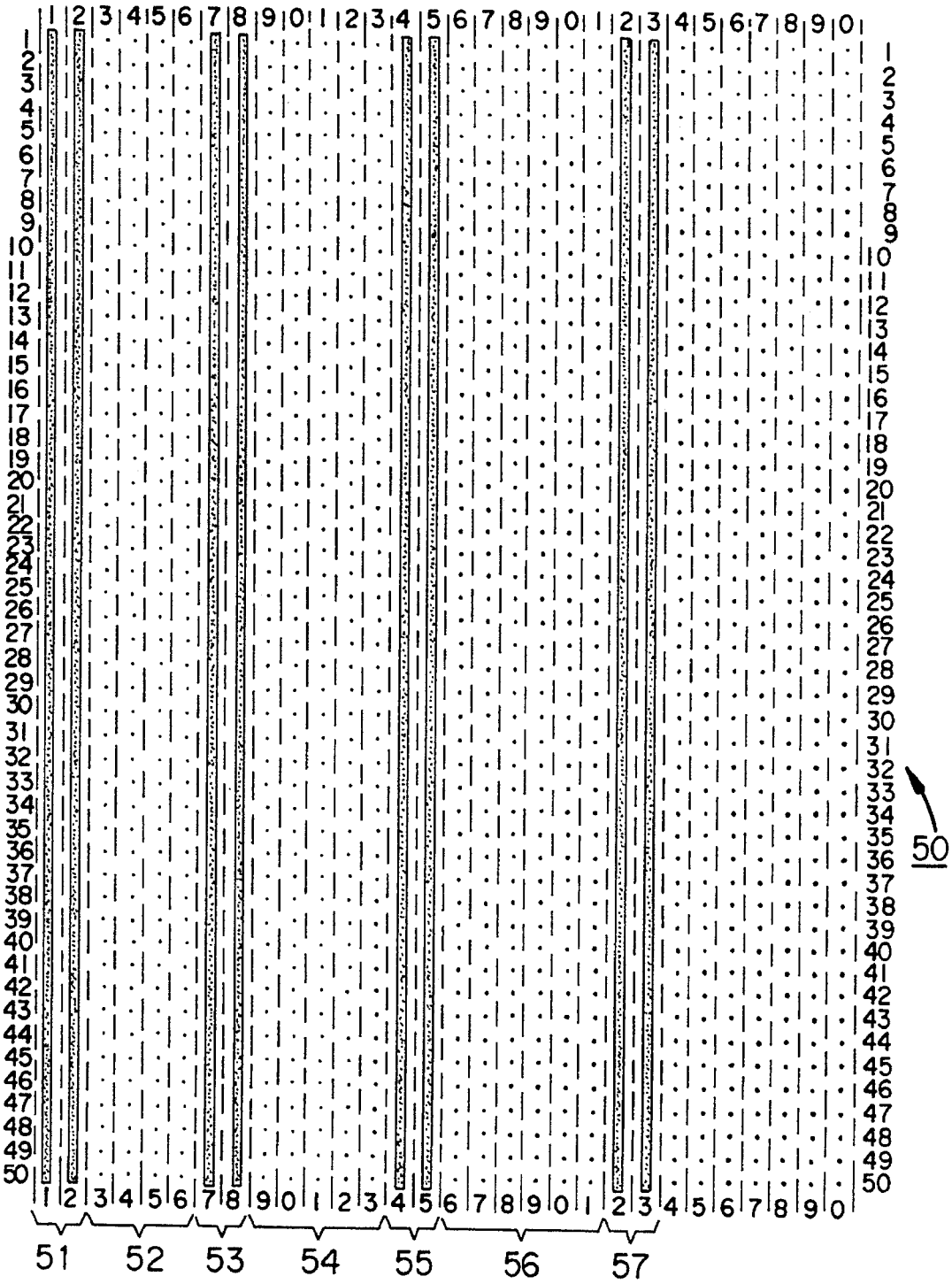
FIG. 2 is a first example for the performance of the invention method employing a first test grid pattern.

A suitable first test pattern 50 is shown in detail in FIG. 2 relative to the recording-device-proper, absolute grid pattern, illustrated in part. A first line 51 is formed by two gaps No. 1 and No. 2 of the recording-device-proper grid pattern including, respectively, 50 dots. The two gaps No. 1 and No. 2 are disposed next to each other on the recording device 18, illustrated in FIG. 1. A region 52 left open between imprinted marks, comprising four gaps No. 3 through No. 6 of the grid pattern, is delimited next to the outer line 51 by a further line 53. This further line 53 again comprises two adjacently illustrated gaps No. 7 and No. 8. A further region 54 is formed by the cooperation of the line 53 with a further line 55. The further line 55 also comprises two gaps No. 14 and No. 15 of the grid pattern and delimits in turn a further region 56 left open between imprinted marks together with a further line 57. The further line 57 is formed in the same way by two gaps No. 22 and No. 23.

Figure 3:
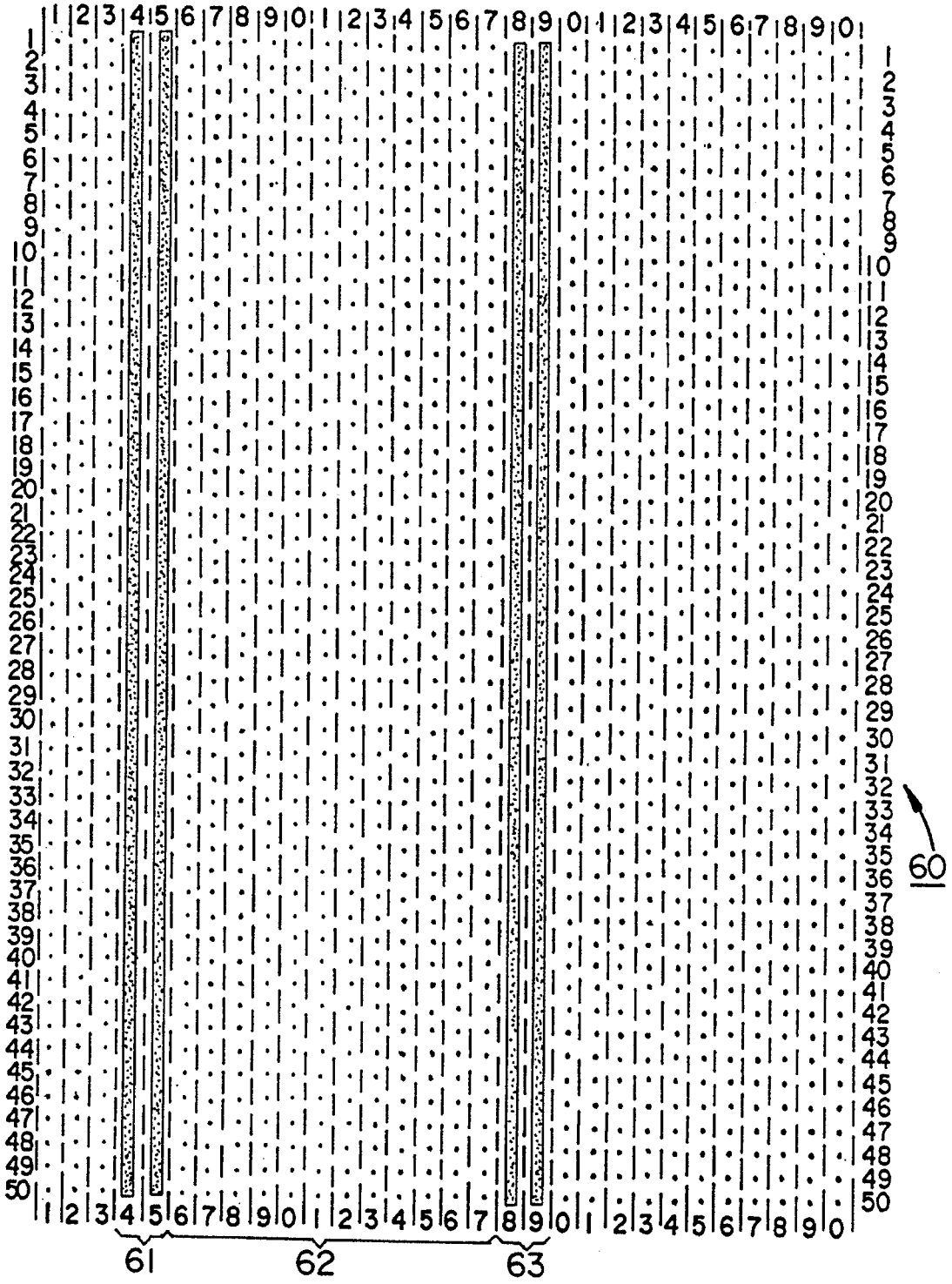
FIG. 3 is a second example for the performance of the invention method employing a second test grid pattern.

A second test pattern 60 for the performance of the invention method is illustrated in FIG. 3 and exhibits a first line 61. This first line 61 is formed by printing of the gaps disposed in the fourth and fifth gaps of the absolute grid pattern. A space 62, formed by twelve gaps and free from recording, is delimited and bounded at the second side by a further line 63 in the grid pattern. The disposition of the lines 61 and 63 is tuned to the disposition of the lines 51 and 53 or 55 and 57, respectively, of FIG. 2 in the grid pattern such that the line 61 is generated exactly in the middle between the lines 51 and 53, illustrated in FIG. 2 in the gaps No. 4 and No. 5, and is thus symmetrical relative to the region 52. In an exact adjustment, the line 63, illustrated in FIG. 3 is generated in the same fashion exactly in the center of the region 56, delimited by lines 55 and 57, illustrated in FIG. 2. The different distance between the lines 51 and 53, forming the region 52, or, respectively, between the lines 55 and 57, forming the region 56, allows initially a coarse adjustment of the line 63 in the region 56 and a subsequent fine adjustment of the line 61 within the region 52.

It is particularly advantageous if the first test grid pattern is repeatedly recorded during the forward motion and if the second test pattern is recorded during the return motion in a corresponding number of times and corresponding position.

Figure 4:
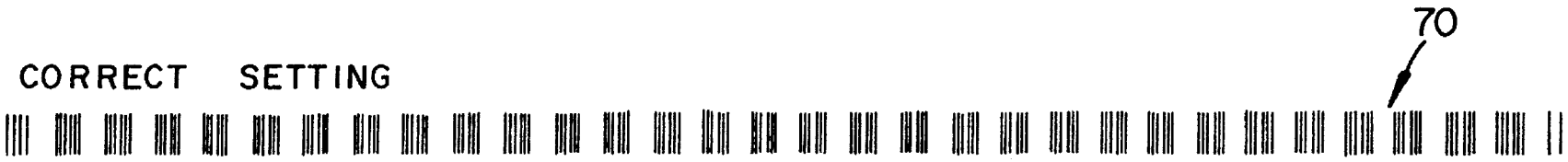
FIG. 4 is a view of an overall test grid pattern in a proper position.
Figure 5:
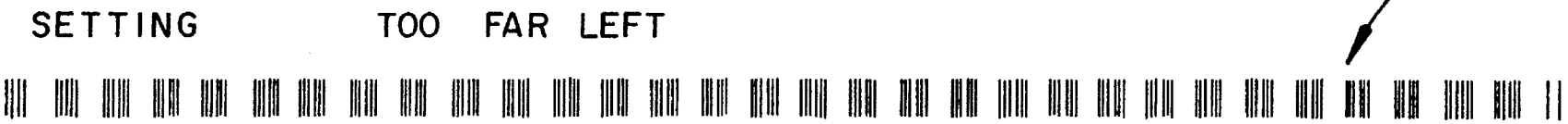
FIG. 5 is a view of the test grid pattern of FIG. 4, however, out of calibration with the center test lines too far left.
Figure 6:
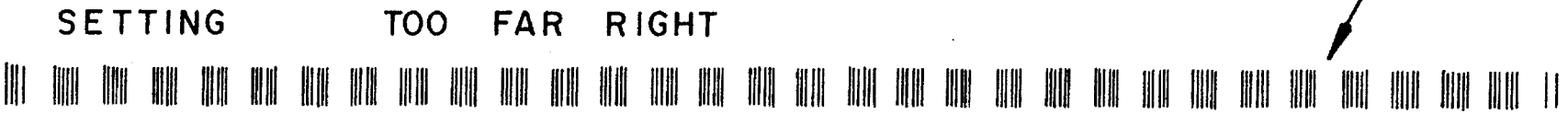
FIG. 6 is a view of the test grid pattern of FIG. 4, however, out of calibration with the center test lines too far right.

The test patterns 50 and 60, illustrated in FIGS. 2 and 3, combined in each case to complete patterns 70, 80, and 90, are illustrated in FIG. 4, 5, and 6.

FIG. 4 illustrates a correct and proper setting of the recording device such that the lines of the test pattern 60, illustrated in FIG. 3, are disposed exactly symmetrically in the region 52, 56 of FIG. 2 in the complete pattern 70.

In contrast, FIGS. 5 and 6 show settings which are to be corrected. In the complete pattern 80 according to FIG. 5, the test pattern 60 according to FIG. 3 is disposed too far to the left relative to the test pattern 50 such that an adjustment of the control of the recording head of FIG. 1 is to be performed in such a sense that the recording point in time during the forward motion occurs earlier such that the grid patterns or, respectively, the test patterns are congruent or symmetrical relative to each other, respectively, during the forward motion and the return motion, as illustrated in FIG. 4. According to FIG. 6, a setting and adjustment is to be performed such that during the return motion the recording point in time is selected to occur somewhat later such that the test pattern 60 of FIG. 3 is recorded symmetrically relative to the test pattern 50 of FIG. 2.

The test pattern 60 of FIG. 3 can of course also be employed as test pattern for the forward motion 30 and, correspondingly, the test pattern 50 of FIG. 2 can be employed for the return motion. The test pattern 50 of FIG. 2, as well, could be comprised of only three lines, which three lines include a broad region left open between imprinted marks and a narrow region left open between imprinted marks. Advantageously, the feed of the recording substrate 18, illustrated in FIG. 1, is reduced or suppressed, respectively, during the adjustment procedure. After an adjustment has been performed in the above-described way, and after the grid pattern of the forward motion coincides and is congruent with the grid pattern of the return motion, the set values are advantageously stored in a memory storage fixed to the recording device. In case of a mechanical adjustment, this is performed by a mechanical setting of a position. In case of an electronic or control-technical adjustment, respectively, the corresponding control values are written to a memory storage, fixedly disposed and attached to the recording device.

It will be understood that each of the elements described above, or two or more together, may also find a useful application in other adjustment methods differing from the methods described above.

While the invention has been illustrated and described as embodied in the context of a method for adjustment of a serial recording device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method for assisting in the detection of incorrect adjustment of a serial recording device including a recording head, comprising the following steps:

performing a forward motion of the recording head and recording a first test pattern having a pair of marks which are spaced apart by a predetermined distance in the direction of forward motion of the recording head to leave a broad open region between the pair of marks; and performing a return motion of the recording head and recording a second test pattern, wherein the first test pattern and the second test pattern are generated relative to each other such that at least a portion of the second test pattern is (i) narrower in the direction of forward motion of the recording head than said predetermined distance and (ii) generated symmetrically within the open region between the pair of marks of the first test pattern.

2. The method according to claim 1, wherein the marks of the first test pattern and the portion of the second test pattern are a plurality of lines running in a direction transverse to the forward and return motion of the recording head.

3. A method for assisting in the detection of incorrect adjustment of a serial recording device as set forth in claim 1 further comprising the steps of:

visually evaluating adjustment of the serial recording device by comparing the position of the first test pattern to the position of the second test pattern; and adjusting the serial recording device in case a misalignment is found during the evaluation step such that, after the adjusting step, the portion of the second test pattern comes to be disposed symmetrically in the region left open between marks of the first test pattern.

* * * * *